United States Patent [19]

Erickson

[11] 3,966,035

[45] June 29, 1976

[54] PRINTER

[76] Inventor: Robert L. Erickson, 1124 - 26th St., Santa Monica, Calif. 90403

[22] Filed: Mar. 1, 1974

[21] Appl. No.: 447,138

[52] U.S. Cl. ..... 197/1 R; 101/93.05
[51] Int. Cl.[2] ..... B41J 3/10
[58] Field of Search ..... 197/1 R; 101/93.05; 335/281, 282, 297

[56] References Cited

UNITED STATES PATENTS

| | | | |
|---|---|---|---|
| 2,869,455 | 1/1959 | Knutsen | 197/1 R X |
| 3,618,514 | 11/1971 | Nyman | 197/1 R X |
| 3,627,096 | 12/1971 | Finnegan | 197/1 R |
| 3,672,482 | 6/1972 | Brumbaugh et al. | 197/1 R |
| 3,804,008 | 4/1974 | Hoyer | 197/1 R X |
| 3,820,643 | 6/1974 | Priebs et al. | 197/1 R |
| 3,837,460 | 9/1974 | Chida et al. | 197/1 R |

*Primary Examiner*—Ralph T. Rader
*Attorney, Agent, or Firm*—Lindenberg, Freilich, Wasserman, Rosen & Fernandez

[57] ABSTRACT

A low cost dot printer head which includes a base plate of ferromagnetic material with slots that divide a rear portion of the plate into several magnetic circuits that are isolated from one another and that hold separate coils for individually magnetizing the circuits, the head also including an armature slideable along each magnetic circuit and a printer wire having a rear end fixed to a corresponding armature and a front end slideable in a guide mounted at the front of the base plate.

9 Claims, 14 Drawing Figures

106
56
60
56a
62
58
58m
S
56e
64
58n
90
58s
90
96
94
56c
56b
56d

PRINTER

BACKGROUND OF THE INVENTION

This invention relates to printing machines.

A variety of devices that require a printed output. such as printing calculators and telephone-connected transceivers, could be available in low priced models if a low cost printing mechanism were available. The recent availability of large scale intregrated circuits at low cost permits the use of complex electronic circuits to minimize the complexity of mechanical components. This permits such relatively simple printing mechanisms as dot printers to be utilized. However, even the relatively simple dot printers have normally required numerous mechanical components, which results in relatively high cost and limited reliability. The design of the printing head is especially critical, inasmuch as it must be precisely and rapidly driven, and even a relatively lightweight head requires a driving mechanism with a mass several times as great. If a printing head of rugged and simple design and of low mass were available, then relatively economical printers could be produced.

SUMMARY OF THE INVENTION

In accordance with one embodiment of the present invention, a dot printer is provided which is of simple and rugged design. The printer has a head which includes a plate of ferromagnetic material which serves as a rugged frame on which the other elements are mounted and which also forms magnetic circuits that are used to activate printer wires. The ferromagnetic plate has a rear portion with numerous slots that form a plurality of magnetic circuits which are isolated from one another, and a separate coil and movable armature is stationed along each circuit. A separate printer wire has a rear end fixed to a corresponding armature and a front end which slides along a corresponding hole in a guide that is mounted at the front end of the ferromagnetic plate. The front of the printing head is positioned adjacent to a roller, with a sheet of paper and inked ribbon between them, so that as the coils are energized to move the armatures the front ends of the wires strike the ribbon to print dots on the paper that form characters.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
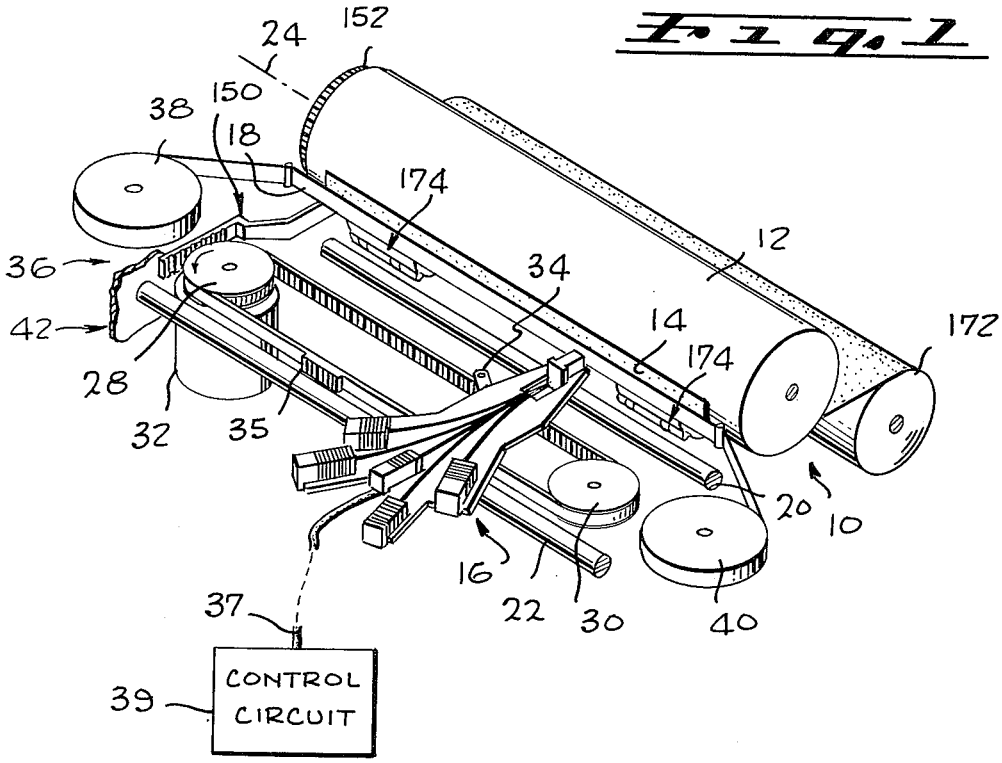
FIG. 1 is a simplified perspective view of a printer constructed in accordance with the invention.
Figure 2:
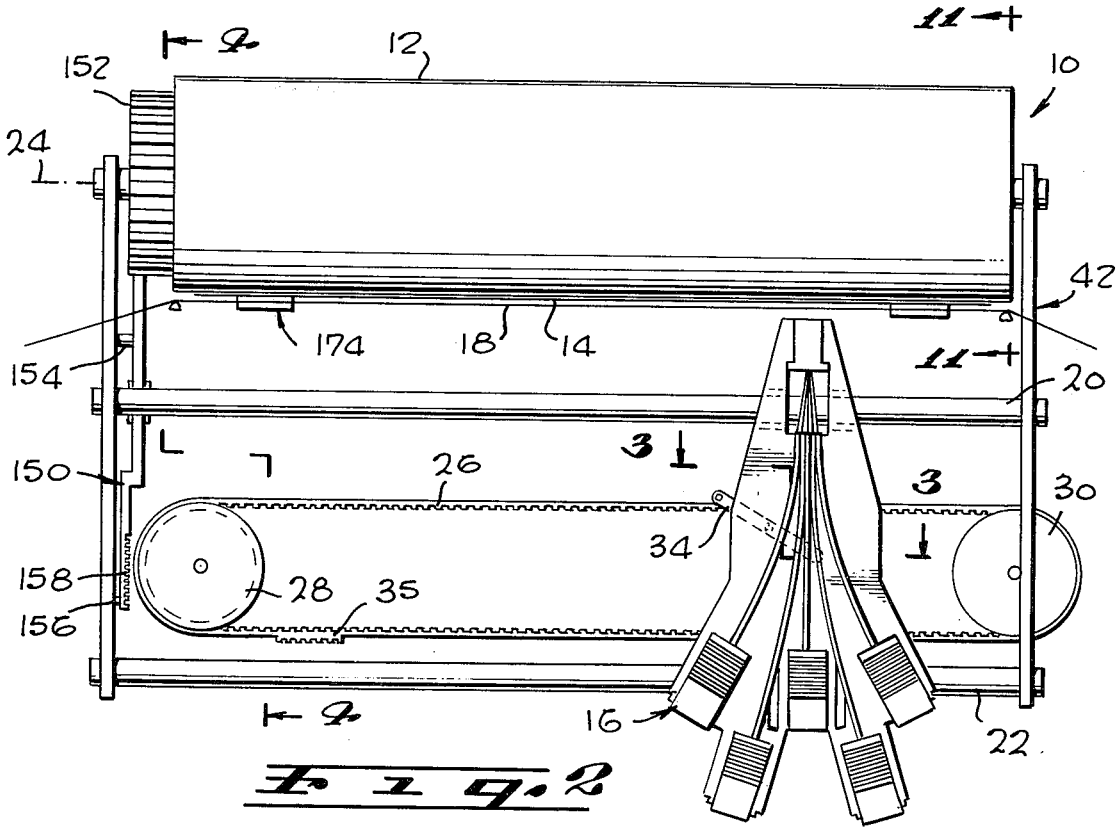
FIG. 2 is a plan view of the printer of FIG. 1, and also showing the frame thereof.

FIGS. 1 and 2 illustrate a printer 10 which includes a platen or roller 12 that backs up a sheet of paper 14 to be printed upon, and a printing head 16 with elements that can impact an inked ribbon 18 to print on the paper. The head 16 is supported on a pair of guide rods 20, 22 that confine it to lateral motion parallel to the axis of rotation 24 of the roller, and the head is driven back and forth along the guide rods by a belt 26. The belt 26 is held in a loop about a pair of pulleys 28, 30 with one of the pulleys 28 being driven by a motor 32. A drive link 34 connects the belt to the printing head 16, so that as the belt rotates the link pulls the printing head back and forth across the paper. A flexible cable 37 electrically connects the printing head 16 to a control circuit 39 to operate printing elements of the printing head. At each rotation of the belt, a group of cogs 35 on the outside of the belt operate a paper advancing mechanism 36 that turns the roller 12 to advance the paper. Also, a mechanism (not shown) advances a pair of ribbon spools 38, 40 about which the ribbon 18 extends, to provide fresh areas of the ribbon at the paper. The various elements of the printer are mounted on a frame 42 which is shown in FIG. 2.

FIGS. 5–10 illustrate details of the printing head 16 which creates impact printing. The head includes five wires **50*a*–50*e* with front ends that slideably extend through holes in a wire guide 52, and with rearward ends that are attached to activating mechanisms 54*a*–54*e* that can move the wires along their lengths. When one of the activating mechanisms such as 54*a* is energized, the corresponding wire 50*a* is shifted forward so that its forward tip projects in front of the guide 52. The tip of the wire then impacts the ribbon against the paper to print a dot on the paper. By energizing the activating mechanisms 54** at controlled times while the printing head moves across the width of the paper, the printing head can be made to print a wide variety of characters, all in a manner well known in the art.

The printing head 16 includes a base plate 56 of ferromagnetic material such as annealed steel, which serves both as a frame upon which the various elements of the head are mounted and as the magnetic flux conductor for the magnetic circuits of the activating mechanisms **54*a*–54*e*. The rear portion of the base plate 56 (FIG. 10) contains numerous apertures or slots which form five magnetic circuits; for example, the plate region 56*a* forms a magnetic circuit of the activator 54*a*. The base plate at the region 56*a* includes a slot or aperture 58 in the shape of a boxy Y, or U with a stem, that has a pair of arms 58*m*, 58*n* and a stem 58*s*. This forms a closed magnetic circuit for conducting closed flux lines indicated by the imaginary lines 60, 62, wherein the magnetic circuit has an air gap at the junction of the two arms 58***m*, 58*n* and a stem 58*s* of the aperture. The activating mechanism basically includes a magnet coil placed around the center leg 64 of the magnetic circuit, and an armature that lies in the air gap at 58*s* and which tends to slide forward towards the center leg 64 to close the air gap when the magnet coil is energized.

Figure 7:
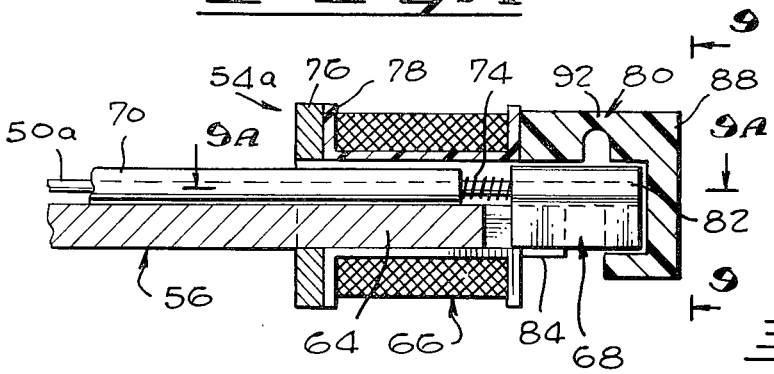
FIG. 7 is a sectional view taken on the line 7—7 of FIG. 5.
Figure 9:
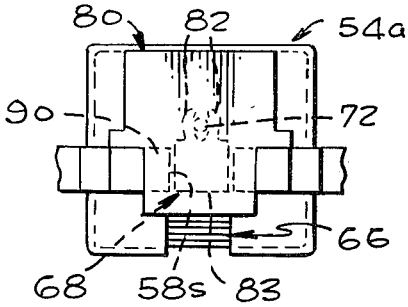
FIG. 9 is a view taken on the line 9—9 of FIG. 7
Figure 8:
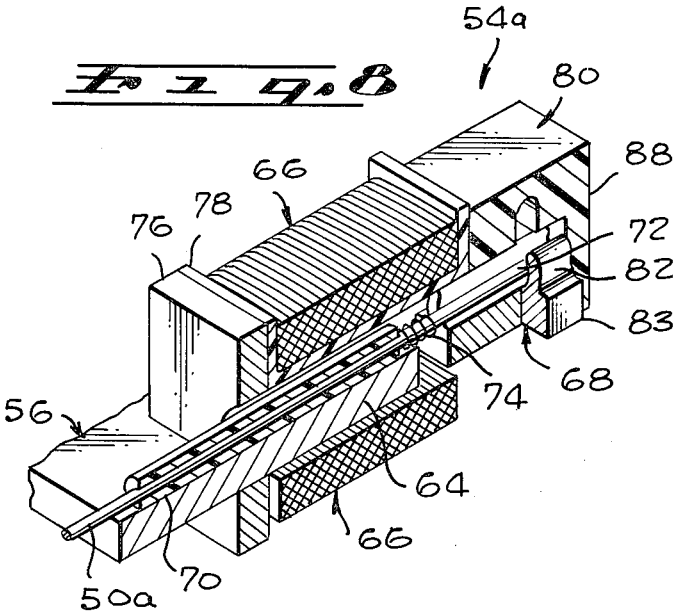
FIG. 8 is a sectional perspective view of the region shown in FIG. 7.

FIGS. 7–9 illustrate additional details of one of the activating mechanisms 54*a*. The mechanism includes a coil 66 of magnet wire which is disposed about the center leg 64, and an armature 68 of ferromagnetic material disposed in the air gap of the magnetic circuit and normally spaced behind the center leg 64. The printer wire 50a slideably extends through a sheath 70 that lies on the base plate 56, and the rear end portion 72 of the wire is fixed to the armature 68. The armature 68 has a width slightly less than the width of the aperture stem portion 58s, and is guided by arms 90 of the magnetic circuit that lie on either side of this stem portion. When the coil 66 is energized, magnetic flux urges the armature 68 forwardly to tend to close the air gap between it and the rear end of the center leg 64, so that the armature and printer wire 50*a* shift forward to cause the imprinting of a dot on the paper. It should be understood that the armature does not have to completely close the air gap when the armature is at its most forward position. When current no longer flows through the coil 66, a spring 74 moves the armature back to its original position. It is obvious from the above that the magnetic material of the plate is of a type wherein the magnetic field therein drops to a low level when the external magnetizing force, such as that produced by current flowing through a coil, ceases.

The activating mechanism 54a also includes an end piece 76 of ferromagnetic material, which is designed to conduct some of the magnetic flux produced by the coil 66 into the plane of the base plate 56. The coil itself is held on a bobbin 78. A backing member 80 is also provided which serves as a rearward stop that limits the rearward movement of the armature 68 and which guides the rear end of the armature against excessive up and down movement. The mechanism can be assembled by positioning the end piece 76 at the front of the aperture 58, installing the bobbin 78 with the coil 66 thereon over the center leg of the base plate and against the front piece 76. The assembly containing the wire 50a and armature 68 is constructed by crimping the rearward end of the wire between a pair of arms 82 of the armature that extend from a body portion 83 of the armature. The printer wire and armature, together with the sheath 70 and spring 74 that lies about the wire, can then be installed by inserting the wire through the hole in the bobbin 78. All of the foregoing elements can then be securely held in place by installing the backing member 80.

Figure 9A:
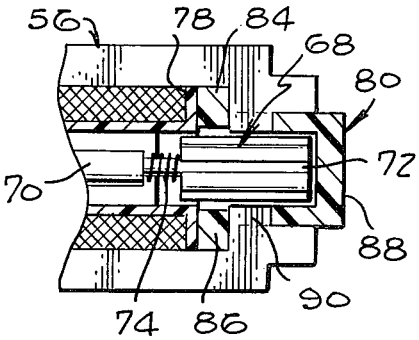
FIG. 9A is a view taken on the line 9A—9A of FIG. 7.
Figure 10:
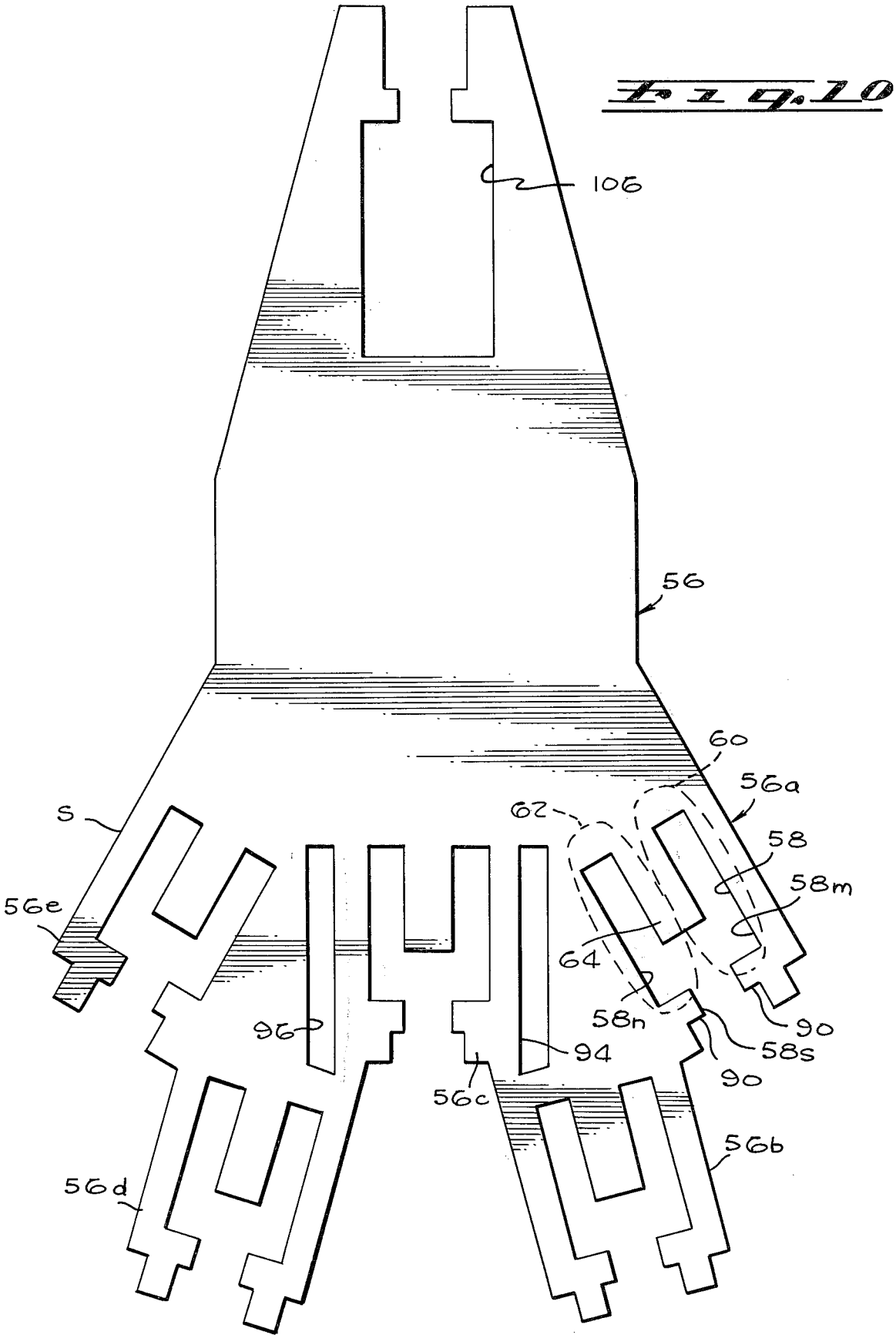
FIG. 10 is a top plan view of the base plate of the printer head of FIG. 5.

The backing member 80 has a pair oflegs 84, 86 (FIG. 9A) that lie on either side of the armature 68 and which lie between the rear of the bobbin 78 and a pair of loop-closing arms 90 formed in the baseplate at the rear of the magnetic circuit. The backing member 80 also has a rear portion 88 that abuts the arms 90 of the magnetic circuit portion. The backing member is formed with a neck at 92 (FIG. 7) to provide for a limited amount of bending between the back portion 88 and the front portions at the legs 84, 86, so that the positions of all parts of the backing member are determined by the arms 90 of the magnetic circuit. This assures that, so long as the aperture 58 in the base plate is accurately formed, the position of the armature 68 will be accurately fixed along the air gap. This is important in assuring that all of the wires 50*a*–50*e* will move a predetermined distance when the corresponding coils are energized, to thereby assure adequate printing from each of the five wires.

The use of a solid base plate 56 to form many magnetic circuits that will lie in the same plane, could lead to the need for an excessively large and wide base plate. This is because each of the five magnetic circuits requires an appreciable width and because the different circuits must be magnetically isolated from one another so that the energization of one circuit does not cause armature movement at another circuit. A minimization of the width and length of the base plate 56 is achieved by positioning the activating mechanism in two tiers spaced one behind the other, with a first tier including the mechanisms 54*a*, 54*c*, and 54*e* and the second tier including the mechanisms 54*b* and 54*d*. If all of the magnetic circuit portions (FIG. 10) 56*a*–56*e*, which all lie in the same plane, also had to lie in the same tier, then the rear portion of the base plate 56 would have to be very wide. With such a wide rear portion, the base plate would have to be constructed with a greater length in order to prevent excessive bending of the wires 50*a* and 50*e* that lie at the extreme sides of the plate. The forming of the magnetic circuit portions in different tiers, one spaced behind the other, and in a staggered arrangement wherein each circuit portion of the second tier lies between a pair of circuit portions of the first tier, enables the use of a base plate 56 of small length and therrefore small mass. This reduces the size of the guides and of the motor and drive pulley, so that a small and low cost printer can be constructed.

The provision of several magnetic circuits in the same base plate can result in a high degree of "cross talk" between adjacent magnetic circuits, particularly those in the forward tier such as between circuits 56*a* and 56*c*, or between circuits 56*c* and 56*e*. Such cross talk is minimized by the provision of isolater slots 94, 96 between the adjacent pairs of magnetic circuits. The entire base plate 56, including the apertures that form the various portions into magnetic characters and the isolator slots, can be formed in a single stamping operation, so that the relatively complex multi-circuit plate can be formed at low cost.

The front guide 52 (FIG. 5) which guides the fronts ends of the wires, has five passages 100*a*–100*e* that are arranged along an imaginary line 102. The line 102 extends largely in a vertical direction along the height of the characters to be printed. However, the line 102 is slanted by an angle A away from the vertical which is represented by an imaginary vertical line 104 that is normal (perpendicular) to the plane of the base plate 56. The provision of a slant angle A, which is at least a few degrees and less than 45°, helps to improve the appearance of printed circuits in spite of small errors in the placement of the dots on the paper. This is because lines which are not straight, appear straighter if they are slanted than if they are precisely vertical. The rear portions of the wires 50*a*–50*e* all lie in the same plane which is slightly above the plane of the base plate 56. The front portions of all of the wires, except the middle one 50*c*, all divert from this plane to positions along the imaginary slant line 102. The base plate 56 is formed with asn aperture 106 at its front end to provide room for such deviation of the front ends of the wires. The wire guide 52 is mounted at the front of this aperture 106.

Figure 3:
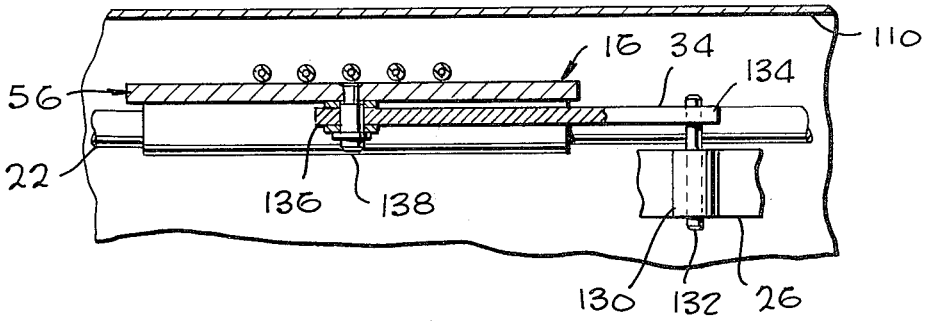
FIG. 3 is a view taken on the line 3—3 of FIG. 2, and also showing a portion of the printer cover.
Figure 13:
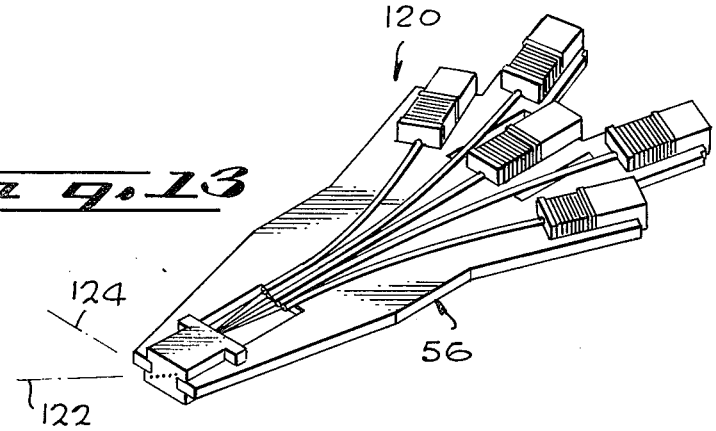
FIG. 13 is a perspective view of a printer head constructed ian accordance with another embodiment of the invention.

The design of the printing head 16 so that the base plate 56 can lie in a horizontal plane while the front ends of the wires extend along a slant line 102 which is almost vertical, permits the construction of a printer with a low profile. If the base plate were to extend vertically, when the rear portion of the base plate would lie considerably above the level of the ribbon 18 and of the characters printed on the paper. A cover plate, such as that shown at 110 in FIG. 3, is normally positioned above the printing head 16 to prevent the head from hitting a person. If the cover plate 110 had to be raised in order to lie above a vertically extending base plate 56, then the cover plate 110 would tend to obscure the line of print that had just been printed. The use of a horizontally extending base plate 56 also facilitates guiding of the printing head 116 along its path of movement, inasmuch as this allows the plane of the base plate 56 to lie only slightly above the two guide rods 20, 22 so that there is a minimal tendency of binding on the guide rods. It may be noted that in some applications, such as where an operator normally does not read the material as it is being printed, the front of the printer wire can be allowed to lie along a line parallel to the plane of the base plate 56 or at only a small slant therefrom. Such a printer head is shown at 120 (FIG. 13), where the line 122 along which the front ends of the printer wires lie, is only several degrees away from a line that is in the plane of the base plate 56.

The use of a belt 26 (FIGS. 1–3) to drive the printing head back and forth across the paper results in a relatively simple head driving mechanism. The belt 26 is a timing belt with cogs on its inner surface, but is also provided with an enlargement or boss 130 on its outer surface for receiving a driving pin 132. The driving link 34 has one end 134 pivotally engaged with the driving pin 132 and has an opposite end 136 pivotally coupled to the base plate 56. Another pin 138 is provided to pivotally connect the base plate 56 to the rear end 136 of the driving link. The belt 26 is driven at a constant speed, so that the link 34 pulls the printing head at a constant speed along most of its path. However, as the driving pin 132 begins to move about a pulley 28 or 30, the speed of the printing head decreases in a smooth fashion to zero speed. A subsequent acceleration in the opposite direction, however, is more sudden.

Figure 4:
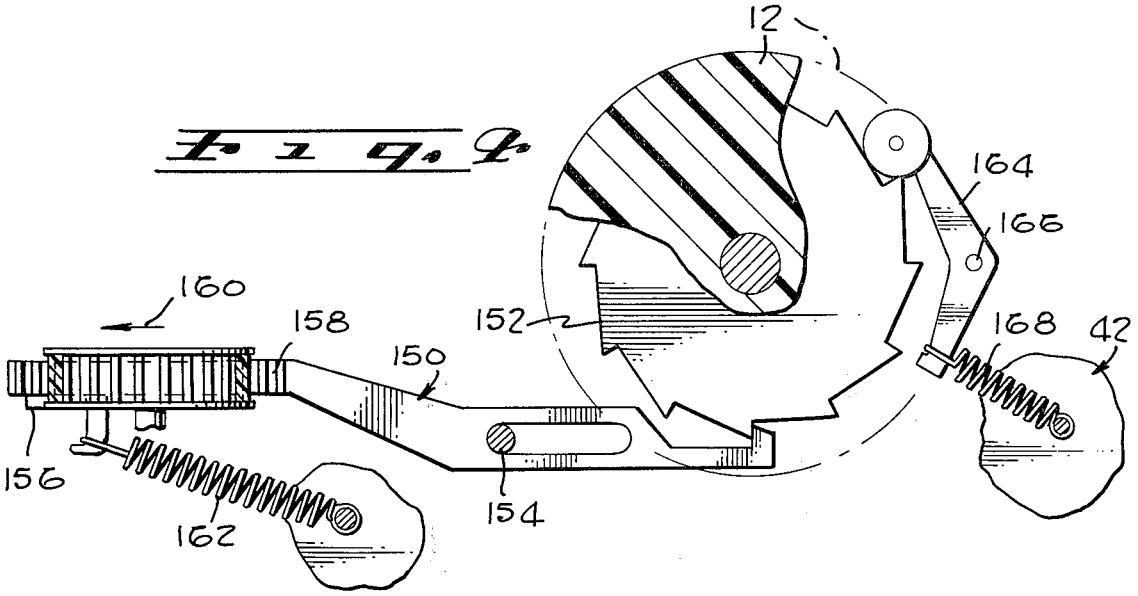
FIG. 4 is a view taken on the line 4—4 of FIG. 2.
Figure 5:
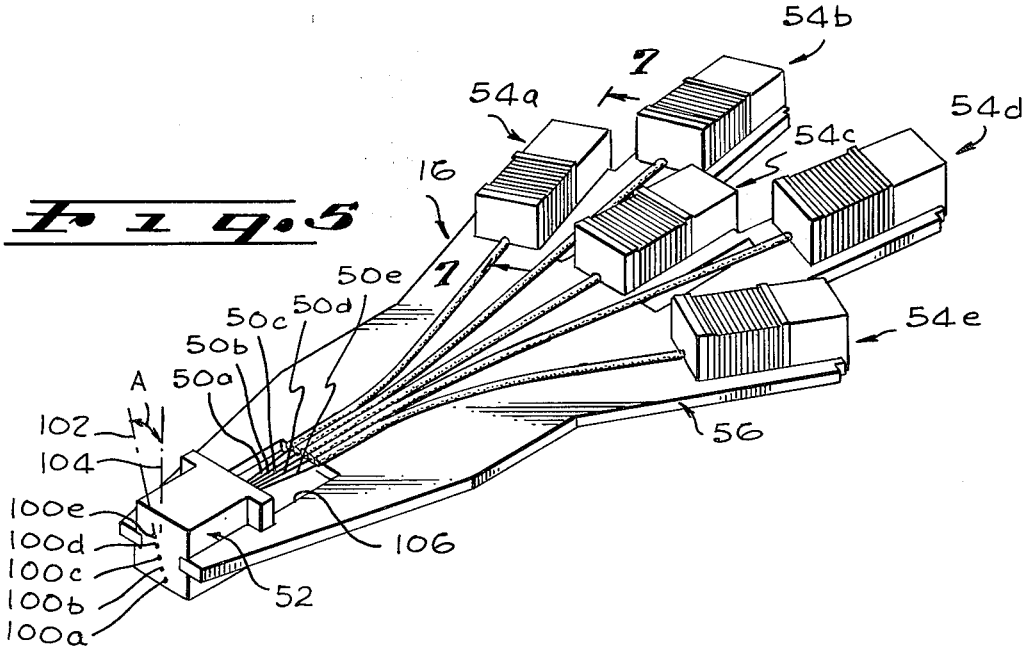
FIG. 5 is a front and top perspective view of the printer head in the printer of FIG. 1.
Figure 6:
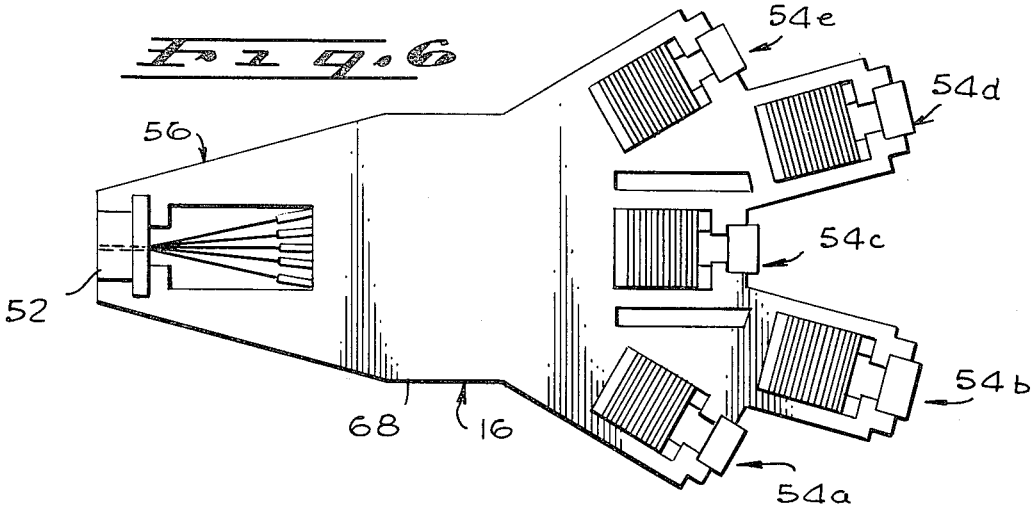
FIG. 6 is a bottom plan view of the printer head of FIG. 5.

After each movement of the printing head across the paper and back again, it is necessary to advance the backup roller 12 to move up the paper. This is accomplished by the paper advance mechanism 36 (FIGS. 1, 2 and 4), which includes an operating member or advancing pawl 150 that is moved by outer cogs 35 on the belt 26, and which also includes a ratchet wheel 152 that is engaged with the pawl and which is fixed to the paper roller 12. The pawl 150 is slideably mounted on a pair of bearings 154, 156 and has a rearward end portion 158 formed as a gear rack with several gear teeth thereon. The gear teeth on the rear portion 158 are spaced sufficiently from the belt pulley 28 so that they are not engaged by any portion of the belt except the outer cogs 35. Whenever the outer cogs 35 pass around the pulley 28, they engaged the teeth on the pawl 150 and move the pawl rearwardly, in the direction of arrow 160. After the cogs 35 pass by, a spring 162 returns the pawl to its original position. Each time the pawl reciprocates, it advances the ratchet wheel 152 to thereby advance the backup roller 12 and the sheet of paper. A retainer lever 164, which is provided to keep the ratchet wheel 152 and back up roller 12 stationary inbetween advances by the pawl, is pivotally mounted at 166 and urged against the ratchet wheel by a spring 168.

Figure 11:
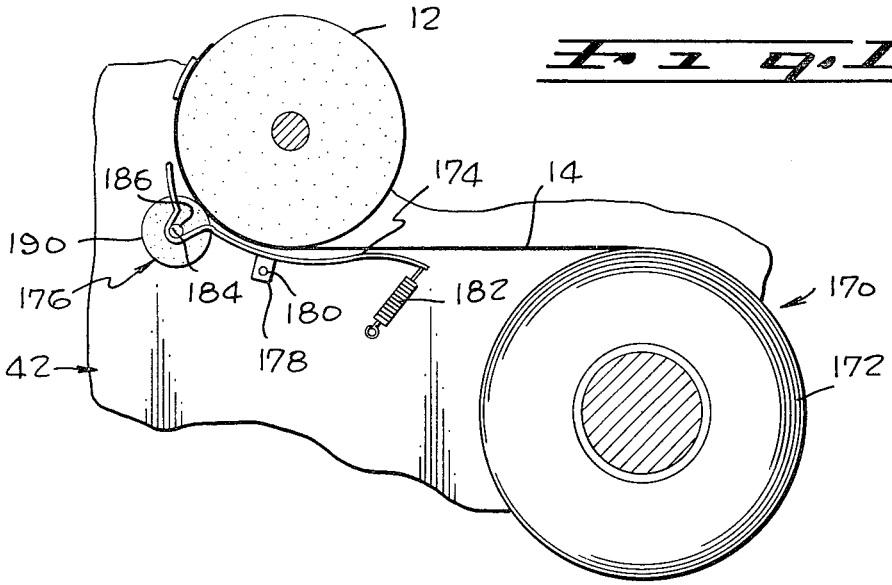
FIG. 11 is a sectional end view taken on the line 11—11 of FIG. 2, and showing the paper guiding mechanism of the printer.
Figure 12:
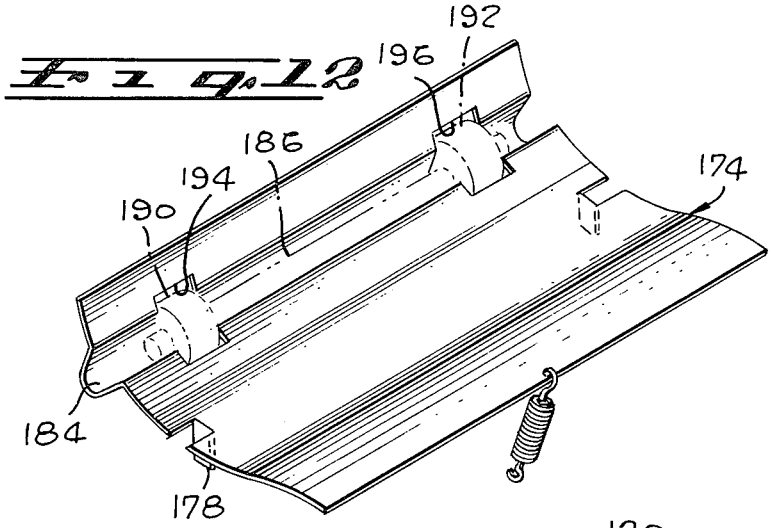
FIG. 12 is a partial perspective view of the paper guiding mechanism of FIG. 11.

The mechanism 170 for guiding the paper 14 onto the backup roller or platen 12, is shown in FIGS. 11 and 12. The paper 14 is supplied in the form of an elongated sheet or roll 172 that is rotatably mounted on the frame of the machine. The paper extends over a paper pan 174 and against a pressure roll 176 that holds the paper against the backup roller 12. Both the paper pan 174 and pressure roll 176 must be biased towards the backup roller. In previous printers, separate pivotal mounting bearings and biasing springs were provided for the paper pan and pressure roll. However, the mounting is simplified in the present invention by rotatably mounting the pressure roll 176 on the paper pan 174. The pan 174 has tabs 178 that are pivotally mounted at 180 on the machine frame 42, and a spring 182 extending from the forward end of the pan to the machine frame biases the rearward end of the pan towards the backup roller 12. The pan is formed with a shaft-receiving recess 184 at its forward end for receiving a shaft 186 of the pressure roll 176 to permit the shaft to rotate therein. The pressure roll has two laterally-spaced roll portions 190, 192 that are mounted on the shaft, and the pan is provided with cutouts 194, 196 at the recess 184, that receive the roll portions. As the spring 182 urges the paper pan 174 to pivot so its front end is biased against the backup roll 12, it causes the pressure roll 176 to be also biased against the backup roll. The pressure roll normally contacts the backup roller 12 when no paper is present, and it holds the front of the pan 174 slightly spaced from the backup roller. Accordingly, the machine eliminates the need for separate pressure roll-supporting arms or a separate spring for biasing such arms.

Thus, the invention provides a dot printer of rugged and simple construction. This is accomplished largely by the use of a printer head which includes a plate of material of high magnetic permeability, with the plate serving as a base on which the other elements of the head are mounted and with the plate having a rear portion divided into a plurality of magnetic circuits. The magnetic circuits are parts of activators that thrust a corresponding printer means, in the form of a printer wire, forwardly to print a dot whenever current is applied to the activator. The magnetic circuit portions are formed in a compact arrangement in which the different magnetic circuits are largely isolated from one another, so that a base plate of relatively small size can be utilized to thereby minimize the size of the printer head guides and moving mechanism.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. In a printer, the improvement of a printing head comprising:

a member of magnetic material having a plurality of apertures forming a plurality of spaced magnetic circuit regions, each circuit region defining a closed magnetic circuit with an air gap;

a plurality of electrical conductor coils, each disposed along one of said magnetic circuits to create a magnetic field in a portion of the member which forms part of the magnetic circuit when the coil is energized;

a plurality of armatures, each moveably mounted along the air gap of one of said magnetic circuits to move in first and second directions wherein the armature moves in directions to respectively close and open the air gap; and a plurality of printer means individually moveable on said member, each printer means attached to a corresponding one of said armatures for making a mark when a corresponding electrical conductor coil is energized;

said member being constructed of magnetic material of a type wherein the magnetic field along each magnetic circuit drops to a low level when the corresponding coil is no longer energized.

2. The improvement described in claim 1 wherein:

said armatures move primarily in predetermined longitudinal directions, and said spaced magnetic circuit regions are arranged in tiers, with a first tier spaced longitudinally from a second tier and with the circuit regions in each tier spaced substantially laterally from one another, and with the circuit regions of the two tiers being staggered in an arrangement wherein each circuit region of the second tier is located behind a position inbetween a pair of circuit regions of the first tier.

3. In a printer, the improvement of a printing head comprising:

a plate of magnetic material having front and rear portions, the rear portion having a plurality of spaced magnetic circuit regions, each circuit region defining a closed magnetic circuit with an air gap;

a plurality of electrical conductor coils, each disposed along one of said magnetic circuits;

a plurality of armatures, each having a portion lying in the plane of said plate at one of said air gaps thereof and slideably mounted along the air gap of one of said magnetic circuits to move in first and second directions wherein the armature moves in directions to respectively close and open the air gap;

a plurality of printer wires, each having a rear portion attached to a corresponding one of said armatures to move with the armature in a direction parallel to armature movement, and each wire having a front portion extending to the front portion of the plate; and a wire guide coupled to the front portion of said plate and slideably guiding the front portions of the wires.

4. The improvement described in claim 3 wherein:

said spaced magnetic circuit regions are arranged in forward and rearward tiers, with the forward tier including first and second substantially laterally spaced circuit regions and with the rearward tier including a third circuit region lying behind a position between said first and second circuit regions.

5. In a printer, the improvement of a printing head comprising:

a plate of magnetic material having front and rear portions, the rear portion having a plurality of spaced magnetic circuit regions, each circuit region defining a closed magnetic circuit with an air gap;

a plurality of electrical conductor coils, each disposed along one of said magnetic circuits;

a plurality of armatures, each moveably mounted along the air gap of one of said magnetic circuits to move in first and second directions wherein the armature moves in directions to respectively close and open the air gap;

a plurality of printer wires, each having a rear portion attached to a corresponding one of said armatures and a front portion extending to the front portion of the plate; and a wire guide coupled to the front portion of said plate and slideably guiding the front portions of the wires;

said spaced magnetic circuit regions including at least three substantially laterally spaced circuit regions (56*a*, 56*c*, and 56*e*), each including a boxy Y-shaped slot (58) and a magnetic circuit portion (64) formed between the arms (58*m*, 58*n*) of the Y slot, each magnetic circuit portion (64) lying within a corresponding one of said coils (66); and said plate including at least two elongated isolator slots (94, 96) lying between adjacent pairs of said magnetic circuit regions.

6. In a printer, the improvement of a printing head comprising:

a plate of magnetic material having front and rear portions, the rear portion having a plurality of spaced magnetic circuit regions, each circuit region defining a closed magnetic circuit with an air gap;

a plurality of electrical conductor coils, each disposed along one of said magnetic circuits;

a plurality of armatures, each moveably mounted along the air gap of one of said magnetic circuits to move in first and second directions wherein the armature moves in directions to respectively close and open the air gap;

a plurality of printer wires, each having a rear portion attached to a corresponding one of said armatures and a front portion extending to the front portion of the plate; and a wire guide coupled to the front portion of said plate and slideably guiding the front portions of the wires;

each of said magnetic circuit regions including a rearwardly-extending center leg (64) and a pair of loop-closing arms (90) lying on either side of a position behind the center leg, and with the circuit region forming a space (58*s*) between said loop-closing arms; and each armature (68) includes a portion having a width slightly less than the width of said space (58*s*) between said loop-closing arms and said armature is slideably guided by said arms in movement towards and away from said center leg.

7. In a printer, the improvement of a printing head comprising:

a plate of magnetic material having front and rear portions, the rear portion having a plurality of spaced magnetic circuit regions, each circuit region defining a closed magnetic circuit with an air gap;

a plurality of electrical conductor coils, each disposed along one of said magnetic circuits;

a plurality of armatures, each moveably mounted along the air gap of one of said magnetic circuits to move in first and second directions wherein the armature moves in directions to respectively close and open the air gap;

a plurality of printer wires, each having a rear portion attached to a corresponding one of said armatures and a front portion extending to the front portion of the plate; and a wire guide coupled to the front portion of said plate and slideably guiding the front portions of the wires;

each of said magnetic circuit regions including a rearwardly-extending center leg (64) and a pair of loop-closing arms (90) lying on either side of a position behind the center leg and with a space (58*s*) between said arms, said armature lying in said space between said arms; and including a plurality of backing members (80) of nonmagnetic material, each enclosing the rear end of a corresponding armature to serve as a back stop that limits rearward movement of the armature, and each back member disposed against the pair of loop-closing arms at the corresponding magnetic circuit to fix the position of the back member.

8. A printing head comprising:

a member which includes a plate portion of magnetic material having apertures forming a plurality of spaced magnetic circuit regions, each circuit region defining a magnetic circuit with an air gap;

a plurality of electrical conductor coils, each disposed along one of said magnetic circuits;

a plurality of armatures, each moveably mounted along the air gap of one of said magnetic circuits to move in first and second directions wherein the armature moves in directions to respectively close and open the air gap; and a plurality of printer means, each attached to a corresponding one of said armatures, for making a mark when a corresponding electrical conductor coil is energized;

each of said apertures including a pair of arms (58*n*, 58*m*) which leaves a center leg (64) of magnetic material between them, and each coil disposed about a corresponding center leg.

9. A printer comprising:

a backup member;

a head guide;

a printing head slideably mounted on said head guide, with a front end slightly spaced from said backup member and with a rearward end opposite the front end, said printing head having a base with front and rear portions, a plurality of printing wires, and means for slideably mounting said wires on said base, said wires having front and rear ends respectively at said front and rear portions of said base, and a plurality of electrically energized activating means coupled to the rear ends of said wires for moving them forward towards the backup member;

means for supporting paper between said backup member and the front end of said printing head; and means for reciprocating said printing head along said guide;

said base of said printing head formed of a solid member of magnetically permeable material of the type wherein the magnetic field drops to a low level when the external magnetizing forces ceases, with said rear portion of said base having apertures defining a plurality of separate magnetic circuits lying in substantially the same plane, each magnetic circuit having an air gap, said printing head having a plurality of armatures slideably mounted in said air gaps and attached directly to the rear ends of said printing wires so that the rear ends of said wires move parallel to movement of said armatures.

* * * * *